US008739902B2

(12) United States Patent
Able

(10) Patent No.: US 8,739,902 B2
(45) Date of Patent: Jun. 3, 2014

(54) HIGH-SPEED TRIPLE STRING DRILLING SYSTEM

(71) Applicant: Dura Drilling, Inc., Bozeman, MT (US)

(72) Inventor: Robert E. Able, Bozeman, MT (US)

(73) Assignee: Dura Drilling, Inc., Bozeman, MT (US)

( * ) Notice: Subject to any disclaimer, the term of this patent is extended or adjusted under 35 U.S.C. 154(b) by 0 days.

(21) Appl. No.: 13/804,368

(22) Filed: Mar. 14, 2013

(65) Prior Publication Data

US 2014/0041942 A1 Feb. 13, 2014

Related U.S. Application Data

(60) Provisional application No. 61/680,352, filed on Aug. 7, 2012.

(51) Int. Cl.
*E21B 17/00* (2006.01)

(52) U.S. Cl.
USPC ..... 175/350; 175/320; 175/295

(58) Field of Classification Search
USPC ..... 175/350, 344, 406, 295, 320, 57
See application file for complete search history.

(56) References Cited

U.S. PATENT DOCUMENTS

| | | | |
|---|---|---|---|
| 3,565,190 | A | 2/1971 | Morindo Ishii |
| 3,664,441 | A | 5/1972 | Carey |
| 3,921,823 | A | 11/1975 | Bourree et al. |
| 3,963,076 | A | 6/1976 | Winslow |
| 3,970,335 | A | 7/1976 | Curington et al. |
| 4,007,797 | A | 2/1977 | Jeter |
| 4,368,786 | A | 1/1983 | Cousins |
| 4,396,075 | A | 8/1983 | Wood et al. |
| 4,415,205 | A | 11/1983 | Rehm et al. |
| 4,603,739 | A | 8/1986 | Krugh |
| 4,618,172 | A | 10/1986 | Becker |
| 4,691,790 | A | 9/1987 | Reichman et al. |
| 4,844,182 | A | 7/1989 | Tolle |
| 4,881,605 | A | 11/1989 | Warren et al. |
| 4,913,466 | A | 4/1990 | Becker |
| 4,940,098 | A | 7/1990 | Moss |
| 5,060,737 | A | 10/1991 | Mohn |
| 5,069,297 | A | 12/1991 | Krueger et al. |
| 5,186,266 | A | 2/1993 | Heller |
| 5,669,457 | A | 9/1997 | Sebastian et al. |
| 5,711,382 | A | 1/1998 | Hansen et al. |
| 5,862,866 | A | 1/1999 | Springer |
| 6,015,015 | A | 1/2000 | Luft et al. |
| RE36,556 | E | 2/2000 | Smith et al. |
| 6,056,073 | A | 5/2000 | Boulet |

(Continued)

FOREIGN PATENT DOCUMENTS

| | | | |
|---|---|---|---|
| WO | WO-9931346 | A1 | 6/1999 |
| WO | WO-0218742 | A1 | 3/2002 |
| WO | WO-2006014417 | A2 | 2/2006 |
| WO | WO-2009044161 | A2 | 4/2009 |

*Primary Examiner* — Yong-Suk (Philip) Ro
(74) *Attorney, Agent, or Firm* — Goodwin Procter LLP

(57) ABSTRACT

A drilling system for boring into ground includes a bottom hole assembly having a rotatable casing shoe, an independently rotatable driveshaft disposed within the casing shoe, and a bearing housing interdisposed between the driveshaft and the casing shoe to control a distance between a centerline of the driveshaft and a centerline of the casing shoe. The driveshaft includes a bit disposed at a distal end thereof, extending beyond the casing shoe distal end. The driveshaft centerline and the casing shoe centerline are substantially parallel and radially offset.

30 Claims, 9 Drawing Sheets

(56) References Cited

U.S. PATENT DOCUMENTS

| | | | | |
|---|---|---|---|---|
| 6,065,550 | A | 5/2000 | Gardes | |
| 6,315,063 | B1 | 11/2001 | Martini | |
| 6,513,605 | B1 | 2/2003 | Lodden | |
| 6,588,509 | B2 | 7/2003 | Allyn et al. | |
| RE38,418 | E | 2/2004 | Deken et al. | |
| 6,761,231 | B1 | 7/2004 | Dock et al. | |
| 6,827,145 | B2 | 12/2004 | Fotland et al. | |
| 6,827,158 | B1 | 12/2004 | Dimitroff et al. | |
| 6,857,487 | B2 | 2/2005 | Galloway et al. | |
| 6,892,829 | B2 | 5/2005 | Livingstone | |
| 6,895,678 | B2 | 5/2005 | Ash et al. | |
| 7,066,284 | B2 * | 6/2006 | Wylie et al. | 175/65 |
| 7,077,165 | B2 | 7/2006 | Takasaki et al. | |
| 7,152,700 | B2 | 12/2006 | Church et al. | |
| 7,311,148 | B2 | 12/2007 | Giroux et al. | |
| 7,353,889 | B1 | 4/2008 | Gunsaulis et al. | |
| 7,562,725 | B1 * | 7/2009 | Broussard et al. | 175/93 |
| 7,757,784 | B2 | 7/2010 | Fincher et al. | |
| 7,896,108 | B2 | 3/2011 | Able et al. | |
| 7,938,198 | B2 | 5/2011 | He | |
| 7,938,201 | B2 | 5/2011 | Giroux et al. | |
| 8,141,657 | B2 | 3/2012 | Hutton | |
| 2003/0132034 | A1 | 7/2003 | Sharp et al. | |
| 2003/0141111 | A1 | 7/2003 | Pia | |
| 2005/0167158 | A1 | 8/2005 | Fanuel et al. | |
| 2006/0016623 | A1 | 1/2006 | Richard et al. | |
| 2007/0017707 | A1 | 1/2007 | Fanuel et al. | |
| 2007/0034408 | A1 | 2/2007 | Benzie et al. | |
| 2008/0217062 | A1 * | 9/2008 | Southard | 175/57 |
| 2010/0038080 | A1 | 2/2010 | McAfee et al. | |
| 2010/0175922 | A1 | 7/2010 | Ignova et al. | |
| 2012/0043092 | A1 | 2/2012 | Arizmendi, Jr. et al. | |
| 2012/0067435 | A1 | 3/2012 | McGraw et al. | |
| 2012/0067647 | A1 | 3/2012 | Savage | |
| 2012/0080235 | A1 | 4/2012 | Sheppard et al. | |
| 2012/0273275 | A1 * | 11/2012 | Broussard, Jr. | 175/57 |

* cited by examiner

HIGH-SPEED TRIPLE STRING DRILLING SYSTEM

CROSS-REFERENCE TO RELATED APPLICATION

This application claims priority to and the benefit of, and incorporates herein by reference in its entirety, U.S. Provisional Patent Application No. 61/680,352, which was filed on Aug. 7, 2012.

TECHNICAL FIELD

In various embodiments, the invention relates to drilling systems and, more particularly, to multiple string orbital drilling systems for creating holes in the ground.

BACKGROUND

Deposits of oil and natural gas beneath the surface of the earth are typically accessed through boreholes formed by rotating and advancing a drill string, which may be many thousands of feet long, into the ground. Existing dual string drilling systems include an inner string or pipe rotating within an outer string or pipe. At the bottom of the borehole, a drill bit is attached to the inner and/or outer string and is rotated and advanced into the ground to form the borehole. A drilling fluid is pumped into and out of the borehole to lubricate the drill bit and remove cuttings.

Existing dual string drilling systems suffer from several drawbacks. For example, the cuttings are typically returned through an annulus between the inner string and the outer string. The abrasive return fluid, in contact with the high-speed inner string, causes significant wear, especially when large cuttings get trapped between the high speed driveline and the outer string. The wear can increase costs by shortening the life of the drill strings, or cause drill string failure.

Dual string drilling systems may also exhibit drill string vibration, especially when the drill strings are thousands of feet long. Unexpected and damaging vibrations have been observed in drilling systems even when rotating at relatively low speed (e.g., about 150 RPM).

Depending on the particulars of the drilling system, the drilling system may also experience borehole deflection, especially when hard materials or layers in the earth are encountered. For example, when drilling at an angle through layers of varying hardness (e.g., bedding planes), the drill may tend to follow a softer material, which can cause mild to severe borehole deflection. Since the objective of the drilling process is generally to reach a particular target (e.g., an oil or natural gas deposit), deflection of the borehole can be a critical problem.

Another concern with existing drilling systems is that the drill strings may become disconnected (e.g., spin-off) during drilling. For example, in a high speed dual string system, if both strings have the same thread direction (e.g., right-handed thread) and the faster-rotating inner string catches on the outer string (e.g., due to a cutting chip becoming jammed between the two strings), torque will be transmitted to the outer string from the inner string. The torque transmission may unscrew or spin-off one of the drill string joints on the outer string above the jamming location. At best, time and money will be lost retrieving the disconnected drill string. At worst, both drill strings are lost and the hole must be abandoned.

Needs exist, therefore, for improved drilling systems that minimize wear, reduce vibrations, provide better direction control when drilling through layers of varying hardness, and reduce the likelihood of spin-off.

SUMMARY OF THE INVENTION

In various embodiments, the present invention features triple-string drilling systems for creating holes in the ground. The drilling systems may be used for accessing oil or natural gas deposits, mining, construction, geothermal power systems, geoexchange systems, and obtaining information about underground formations. Compared to previous systems, the drilling systems described herein provide several advantages, including: higher rates of penetration, more economical drilling of small diameter holes (e.g., less than about 5 inches in diameter), reduced operating costs, reduced capital equipment costs, more effective fluid return, and improved control over the borehole shape and direction.

In general, in one aspect, embodiments of the invention relate to a drilling system for boring into ground. The drilling system includes a bottom hole assembly that includes: a rotatable casing shoe having a distal end; an independently rotatable driveshaft disposed within the casing shoe, the driveshaft including a bit disposed at a distal end thereof extending beyond the casing shoe distal end; and a bearing housing interdisposed between the driveshaft and the casing shoe to control a distance between a centerline of the driveshaft and a centerline of the casing shoe, wherein the driveshaft centerline and the casing shoe centerline are substantially parallel and radially offset.

In certain embodiments, the casing shoe includes a cutter at a distal end thereof. The casing shoe and/or the bearing housing may define an internal passage to permit drilling fluid and any cuttings to be conveyed away from a cutting zone toward a proximal end of the casing shoe. In one embodiment, the driveshaft includes tubing forming an internal passage adapted to direct drilling fluid to the bit. The bearing housing may be adapted to mate with the casing shoe to prevent relative rotation therebetween. The bearing housing may be axially translatable relative to the casing shoe between a retracted disengaged position to an extended engaged position.

In some embodiments, the bearing housing includes a projection adapted to mate with an aperture formed in the casing shoe. The projection may include a pair of wings and the aperture may include a corresponding pair of longitudinally disposed slots. The slots may be canted circumferentially. In one embodiment, the bearing housing is adapted to mate with the casing shoe to permit relative rotation therebetween. In another embodiment, the bearing housing forms an offset bore to support the driveshaft and includes a radial support adapted to mate positively with an internal surface of the casing shoe.

In certain embodiments, the casing shoe includes an axial stop adapted to limit axial advancement of the bearing housing with respect to the casing shoe. At least one of the casing shoe, the driveshaft, and the bearing housing may be adapted to be translated longitudinally relative to at least one other. In one embodiment, each of the casing shoe, the driveshaft, and the bearing housing are adapted to be translated longitudinally relative to each other.

In some embodiments, the drilling system includes a drill string assembly coupled to the bottom hole assembly. The drill string assembly includes an outer drill string coupled to the casing shoe; an inner drill string disposed within the outer drill string and coupled to the driveshaft, the inner drill string forming an interior passage; and an intermediate drill string interdisposed between the outer drill string and the inner drill string, the intermediate drill string coupled to the bearing housing. The drilling system preferably includes a surface assembly having a drive assembly and a pump assembly. The drive assembly includes: an outer drive unit coupled to the outer drill string; an inner drive unit coupled to the inner drill string; and an intermediate drive unit coupled to the intermediate drill string. The pump assembly includes: an outer pump adapted to pump an outer fluid (e.g., a mud drilling fluid or a completion fluid such as salt water) between the ground and the outer drill string; an inner pump adapted to pump an inner fluid (e.g., a clear fluid or mud drilling fluid) through the interior passage of the inner drill string; and an intermediate pump adapted to pump an intermediate fluid (e.g., a lubricating fluid) through an annular space formed between the intermediate drill string and the inner drill string. Any of the fluids (e.g., the intermediate fluid, the inner fluid, and/or the outer fluid) may include a gaseous component, which is most commonly used for aiding fluid return, but may have other applications such as treating the formation.

In certain embodiments, the outer drive unit is adapted to rotate the casing shoe relative to ground and/or longitudinally translate the casing shoe relative to ground. In one embodiment, the inner drive unit is adapted to rotate the driveshaft relative to ground and/or longitudinally translate the driveshaft relative to ground. In another embodiment, the intermediate drive unit is adapted to rotate the bearing housing relative to ground and/or longitudinally translate the bearing housing relative to ground. Each of the outer drive unit, the inner drive unit, and the intermediate drive unit may be adapted to be locked to at least one of ground and another drive unit. The drive assembly may include a second outer drive unit coupled to the outer drill string. In one embodiment, the inner string includes a wide portion and the intermediate string includes a narrow portion to prevent the inner string from dropping through the intermediate string.

In another aspect, the invention relates to a method for boring into ground. The method includes the steps of: orbiting and advancing into the ground a high speed rotating bit mounted to a driveshaft to form a bore having a nominal diameter; following the bit with a casing shoe independently rotating at lower speed and having a diameter substantially equivalent to the nominal diameter; and controlling a distance between a centerline of the driveshaft and a centerline of the casing shoe, such that the driveshaft centerline and the casing shoe centerline are substantially parallel and radially offset.

In certain embodiments, the controlling step includes adjusting the distance between the centerline of the driveshaft and the centerline of the casing shoe by longitudinally translating a bearing housing interdisposed between the driveshaft and the casing shoe. In one embodiment, the controlling step includes adjusting the distance between the centerline of the driveshaft and the centerline of the casing shoe by rotating a bearing housing interdisposed between the driveshaft and the casing shoe. The method may also include cutting along the bore with the casing shoe. In some embodiments, the method includes providing a fluid to the bit via an internal passage formed in the driveshaft. The fluid and any cuttings may be conveyed away from a cutting zone via an internal passage formed in the casing shoe toward a proximal end of the casing shoe.

In certain embodiments, the controlling step includes utilizing a bearing housing interdisposed between the driveshaft and the casing shoe, wherein the bearing housing is adapted to mate with the casing shoe to prevent relative rotation therebetween. The method may also include the step of axially translating the bearing housing relative to the casing shoe between a retracted disengaged position and an extended engaged position. A projection of the bearing housing may be mated with an aperture formed in the casing shoe. The projection may include a pair of wings and the aperture may include a corresponding pair of longitudinally disposed slots, which may be canted circumferentially. The controlling step may also include utilizing a bearing housing interdisposed between the driveshaft and the casing shoe, wherein the bearing housing is adapted to mate with the casing shoe to permit relative rotation therebetween.

In certain embodiments, the method includes the steps of supporting the driveshaft in an offset bore formed in the bearing housing and mating a radial support of the bearing housing positively with an internal surface of the casing shoe. The bearing housing may be mated positively with an axial stop of the casing shoe. The controlling step may include utilizing a bearing housing interdisposed between the driveshaft and the casing shoe, and the method may also include the step of longitudinally translating at least one of the casing shoe, the driveshaft, and the bearing housing relative to at least one other. Each of the casing shoe, the driveshaft, and the bearing housing may be adapted to be translated longitudinally relative to each other.

In some embodiments, the method includes the step of withdrawing the bit and the driveshaft from the bore formed in the ground while leaving the casing shoe in place. The method may also include at least one of renewing and replacing the bit, and reinserting the driveshaft into the bore to continue forming the bore. The controlling step may include utilizing a bearing housing interdisposed between the driveshaft and the casing shoe, and the withdrawing step may include withdrawing the bearing housing. In one embodiment, the bearing housing is retracted to a disengaged position before the bit and the driveshaft are withdrawn. In various embodiments, withdrawing the bit and the driveshaft may occur while rotating an outer drill string coupled to the casing shoe and/or while pumping a fluid between the outer drill string and the bore.

In certain embodiments, an outer drill string is coupled to the casing shoe, an intermediate drill string is coupled to a bearing housing, and an inner drill string is coupled to the driveshaft, and the method includes the step of adjusting a length of the outer drill string, the intermediate drill string, and/or the inner drill string. Adjusting the length of the outer drill string, the intermediate drill string, and/or the inner drill string may occur while rotating the outer drill string and/or while pumping a fluid between the outer drill string and the bore, wherein the outer drill string is coupled to the casing shoe. The method may also include pumping a mud drilling or other fluid between the outer drill string and the bore, pumping a fluid (e.g., water, brine, or drilling mud) through an interior passage formed in the inner drill string, and pumping an intermediate fluid through an annular space between the inner drill string and the intermediate drill string. Each fluid may include a gaseous component.

These and other objects, along with advantages and features of embodiments of the present invention herein disclosed, will become more apparent through reference to the following description, the figures, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1:
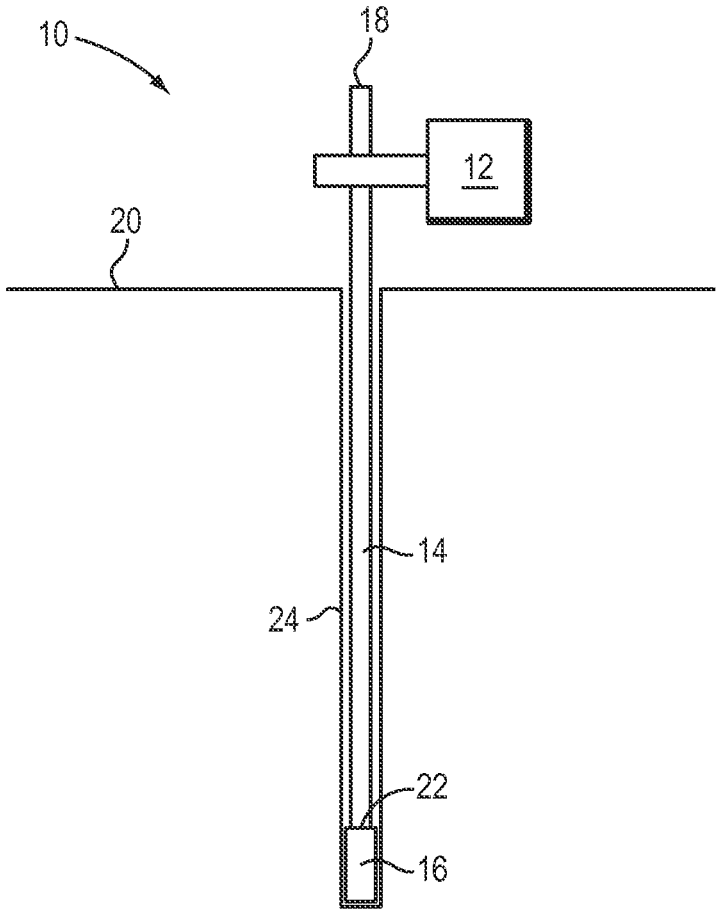
FIG. 1 is a schematic, cross-sectional view of a drilling system for creating a borehole in the ground, in accordance with one embodiment of the invention.

FIG. 1 depicts a drilling system 10 for creating holes in the ground, in accordance with certain embodiments of the invention. The drilling system 10 includes a drive assembly 12, a drill string assembly 14, and a bottom hole assembly 16. A top end 18 of the drill string assembly 14 is coupled to the drive assembly 12, which is located above a surface 20 the ground, for example, on the back of a truck, a barge, or other vehicle or platform. A bottom end 22 of the drill string assembly 14 is coupled to the bottom hole assembly 16, which is generally located in a borehole 24 in the ground.

To create or lengthen the borehole 24, the drive assembly 12 rotates the drill string assembly 14 and the bottom hole assembly 16, and advances the drill string assembly 14 and the bottom hole assembly 16 into the ground. The bottom hole assembly 16 includes a drill bit that cuts into the ground to produce cuttings or chips at the bottom of the borehole 24. Drilling fluids are pumped into the borehole 24 to provide lubrication, treat and/or stabilize the formation, and carry the cuttings from the bottom of the borehole 24 to the surface 20. As the borehole 24 increases in length, the drill string assembly 14 is extended with additional drill string lengths or sections.

Figure 2:
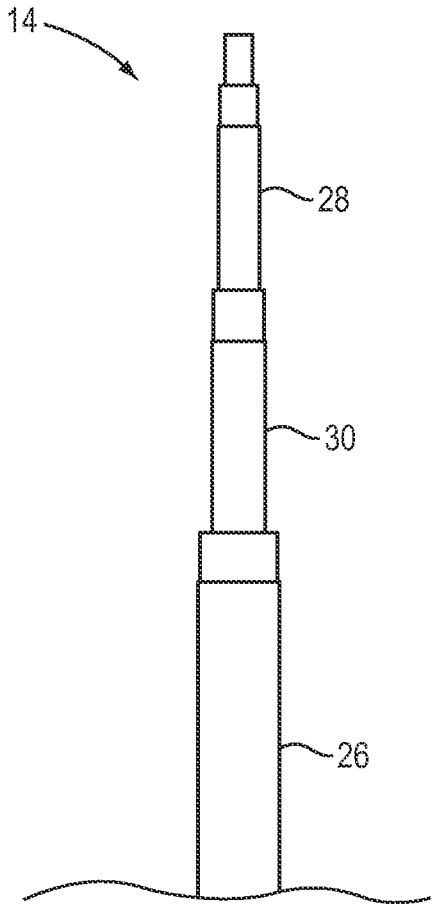
FIG. 2 is a schematic, side view of a drill string assembly, in accordance with one embodiment of the invention.
Figure 3:
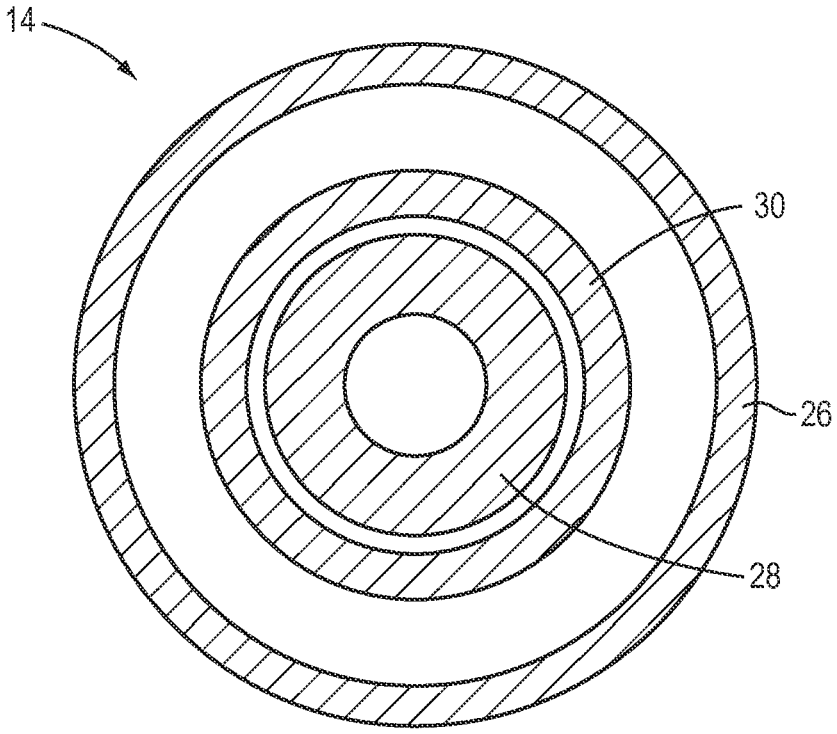
FIG. 3, is a schematic, top, cross-sectional view of a drill string assembly, in accordance with one embodiment of the invention.

Referring to FIGS. 2 and 3, the drill string assembly 14 includes an outer string 26, an inner string or driveline 28, and an intermediate string or conduit 30 nested between the outer string 26 and the inner string 28. The outer, inner, and intermediate strings 26, 28, 30 are not necessarily concentric. Each string is hollow (e.g., a pipe) and has an inner and outer diameter. Maximum, minimum, and typical values for the string inner and outer diameters are provided in Table 1. Drill string lengths are also provided in this table.

TABLE 1

Exemplary system parameters.

| Parameter | Min. | Typical | Max. |
|---|---|---|---|
| Bit diameter (cm) | 1.25 | 5.6 | 50 |
| Casing shoe diameter (cm) | 2.0 | 7.75 | 75 |
| Borehole diameter (cm) | 2.25 | 8 | 76 |
| Borehole depth (m) | 0 | 3000 | 10000 |
| Drill string length (m) | 1 | 3010 | 10010 |
| Outer drill string inner diameter (cm) | 1.75 | 6 | 65 |
| Outer drill string outer diameter (cm) | 1.9 | 7 | 70 |
| Inner drill string inner diameter (cm) | 0.5 | 2 | 10 |
| Inner drill string outer diameter (cm) | 0.8 | 3.5 | 18 |
| Intermediate drill string inner diameter (cm) | 0.9 | 3.6 | 20 |
| Intermediate drill string outer diameter (cm) | 1.1 | 4.5 | 25 |
| Offset distance, D (cm) | 0.2 | 1.25 | 25 |
| Bit rotational speed (RPM) | 0 | 5000 | 15000 |
| Bit rate of penetration (cm/min) | 0.1 | 38 | 150 |
| Bearing housing rotational speed (RPM) | 0 | 80 | 300 |
| Casing shoe rotational speed (RPM) | 0 | 30 | 150 |
| Volumetric flowrate of outer fluid (l/min) | 4 | 50 | 14000 |
| Volumetric flowrate of inner fluid (l/min) | 1 | 40 | 10000 |
| Volumetric flowrate of intermediate fluid (l/min) | 0.02 | 0.2 | 2 |
| Volumetric flowrate of air (l/min) | 0 | 125 | 1500 |
| Radius of curvature of directional drilling (m) | 20 | 150 | 1000 |
| Inner drill string torque (N-m) | 0 | 125 | 10000 |
| Outer drill string torque (N-m) | 0 | 250 | 250000 |
| Intermediate drill string torque (N-m) | 0 | 150 | 1200 |

During operation, each string is connected to a drive unit in the drive assembly 12 that provides the desired rotational and translational motion for the string. Each string may be rotated and/or translated independently, relative to the other strings. In some embodiments, one of the strings (e.g., the intermediate string 30) can be selectively locked to another string (e.g., the outer string 26) so that the two strings share the same rotational motion and/or translational motion.

The axial loading of each string may also be controlled. For example, one or more strings may be in tension and/or one or more strings may be in compression. In one embodiment, the outer string 26 is in axial tension and the intermediate string 30 is in axial compression. Axial compression of the intermediate string 30 may cause the intermediate string to deflect towards (e.g., bow) or press against an inner surface of the outer string 26 (e.g., in a slow spiral fashion), thereby increasing the stiffness of the intermediate string 30. The intermediate string 30 may act as a bearing and/or containment system for the inner string 28.

Each drill string generally includes two or more sections of string or pipe that are coupled together (e.g., with threads) to form a single string. As the depth of the borehole 24 increases, each string may be lengthened by attaching an additional string section at the top end 18 of the drill string assembly 14. In some embodiments, a thread direction for the connection between string sections is chosen to minimize the possibility of spin-off. For example, the intermediate string 30 may include left-handed thread to reduce the possibility of spin-off caused by torque transmission from the high-speed inner string 28. During drilling, when viewed from the top of the borehole 24, the outer string 26 and the inner string 28 are generally rotated in a clockwise direction, while the intermediate string 30 is generally rotated in a counter-clockwise direction.

Figure 4:
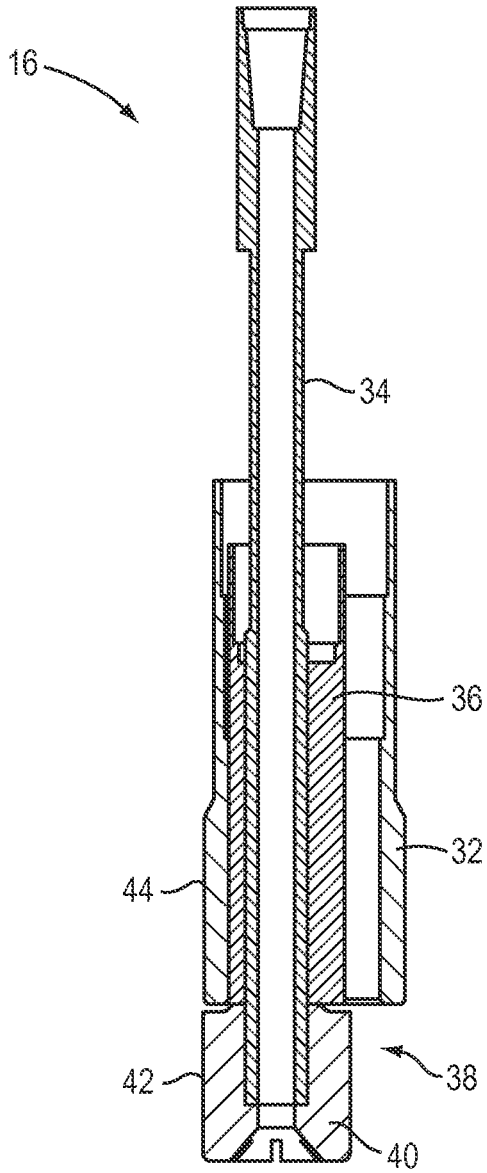
FIG. 4 is a schematic, side, cross-sectional view of a bottom hole assembly, in accordance with one embodiment of the invention.
Figure 5:
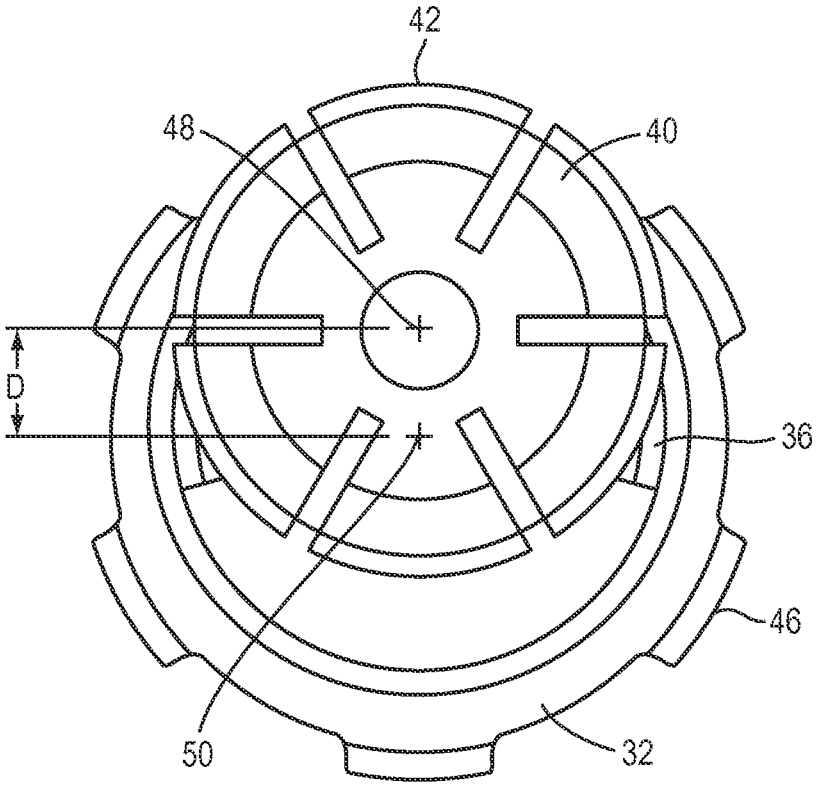
FIG. 5 is a schematic, bottom view of a bottom hole assembly, in accordance with one embodiment of the invention.

Referring to FIGS. 4 and 5, the bottom hole assembly 16 includes a casing shoe 32 coupled to the outer string 26, a driveshaft 34 coupled to the inner string 28, and a bearing housing 36 coupled to the intermediate string 30. A bottom end 38 of the driveshaft 34 includes a drill bit 40 (e.g., a polycrystalline diamond cutter or impregnated diamond bit)

for cutting into the ground and extending the borehole 24. The driveshaft 34 generally has threads/notches or other contours to allow it to attach firmly to the drill bit 40 and to help the bearing housing 36 latch into place within the casing shoe 32. An outer edge 42 of the drill bit 40 generally extends beyond an outer surface 44 of the casing shoe 32 and therefore creates a borehole 24 with a diameter slightly larger than an outer diameter of the casing shoe 32. Minimum, maximum, and typical values for the casing shoe and drill bit diameters are provided in Table 1.

During operation, the casing shoe 32 is generally centered within the borehole 24. The outer surface 44 of the casing shoe 32 may include cutting elements 46 (e.g., a cutter) to remove material from the borehole wall, as needed. Due to reaction forces associated with an orbiting motion of the drill bit 40, the casing shoe 32 may be pushed to one side of the borehole 24 (e.g., in a small orbiting motion).

Still referring to FIGS. 4 and 5, the bearing housing 36 is disposed between the driveshaft 34 and the casing shoe 32, and defines a position of the driveshaft 34 with respect to the casing shoe 32. An offset distance D is a distance between a centerline or center axis 48 of the driveshaft 34 and a centerline or center axis 50 of the casing shoe 32, which is generally the same as a centerline of the borehole 24. The center axis 48 of the driveshaft 34 and the center axis 50 of the casing shoe 32 are substantially parallel.

Figure 6:
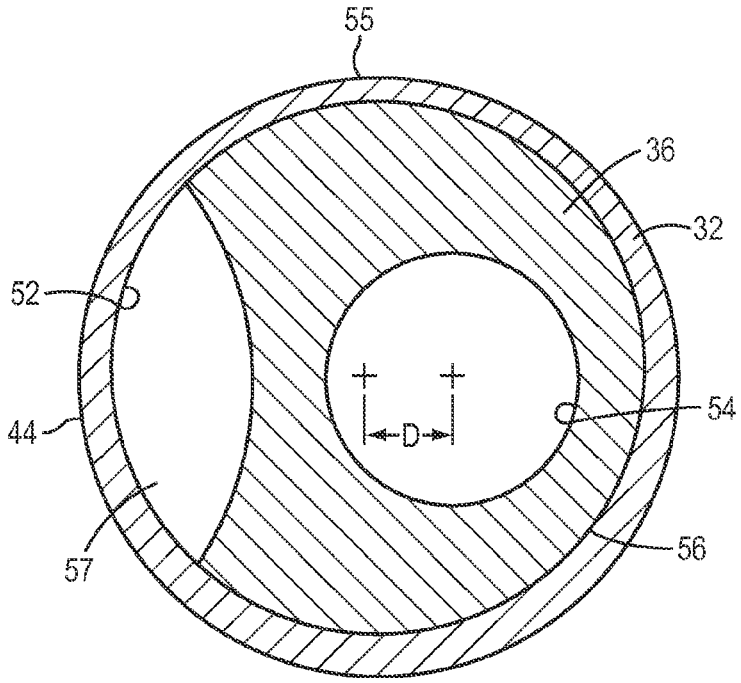
FIG. 6 is a schematic, top, cross-sectional view of a casing shoe and a bearing housing, in accordance with one embodiment of the invention.

In certain embodiments, the offset distance D may be adjusted by rotating or translating the bearing housing 36 with respect to the casing shoe 32. The magnitude of the offset distance D may be infinitely variable within the full range of adjustment. For example, in the embodiment depicted in FIG. 6, the bearing housing 36 and the casing shoe 32 include eccentric bores that allow the offset distance D to be adjusted. Specifically, the casing shoe 32 includes a bore 52 that is not concentric with the outer surface 44 of the casing shoe 32. Likewise, the bearing housing 36 includes a bore 54 that is not concentric with an outer surface 56 of the bearing housing 36. With this configuration, when the bearing housing 36 is rotated with respect to the casing shoe 32, within the casing shoe bore 52, the offset distance D is varied. The offset distance D may therefore be controlled by rotating the intermediate string 30, which is attached to the bearing housing 36, with respect to the outer string 26, which is attached to the casing shoe 32. In general, the ability to control the offset distance D may be used for several purposes, including directional drilling, extended bit life, underreaming, and/or modifying the borehole diameter and/or shape. In the depicted example, the bearing housing 36 defines an opening or passage 57 for one or more fluids to pass through an interior portion of the bottom hole assembly 16. Maximum, minimum, and typical values for the offset distance D are provided in Table 1.

Figure 7:
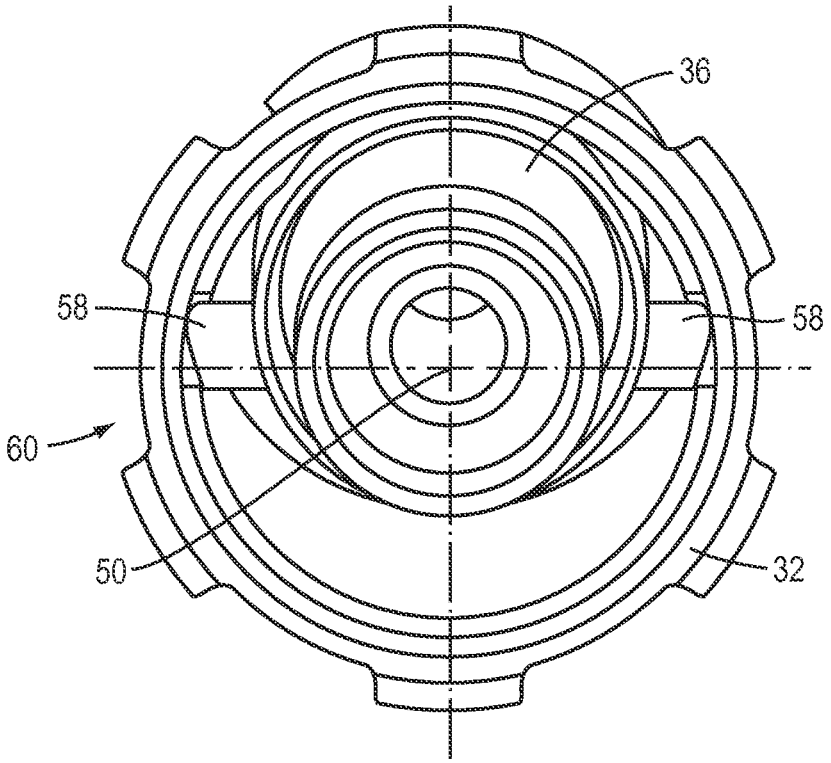
FIG. 7 is a schematic, top view of a bottom hole assembly, in accordance with one embodiment of the invention.
Figure 8:
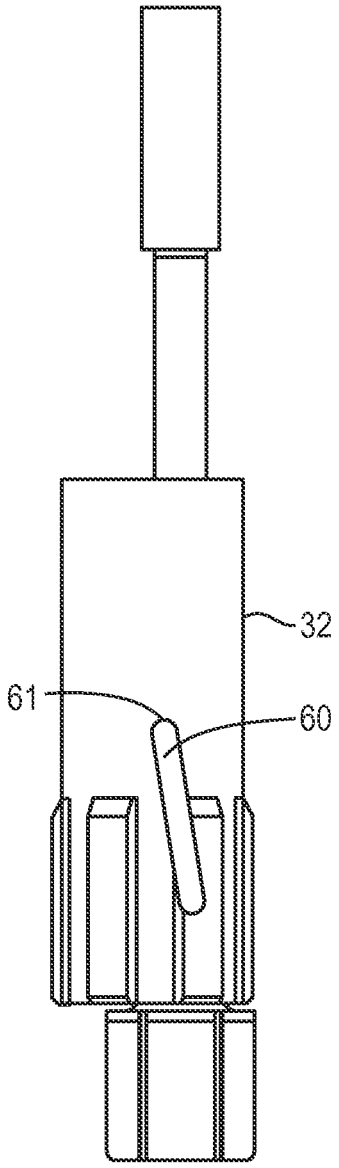
FIG. 8 is a schematic, side view of a bottom hole assembly having canted slots, in accordance with one embodiment of the invention.

In another example, referring to FIGS. 7 and 8, the bearing housing 36 may include outer projections or wings 58 that engage with slots or tracks 60 in the casing shoe 32. The slots or tracks 60 are canted such that movement of the bearing housing 36 in the axial direction may be used to define the offset distance D. In the depicted embodiment, the bearing housing 36 is rotationally locked with the casing shoe 32 and therefore rotates with the casing shoe 32 during drilling. An upper end 61 of the slots 60 may be offset from the centerline 50 of the casing shoe 32 such at the wings 58 of the bearing housing 36 can only be inserted into the slots 60 in one rotational orientation.

Due to the offset distance D, rotation of the casing shoe 32 (attached to the outer string 26) causes the drill bit 40 (attached to the driveshaft 34) to orbit a centerline of the borehole 24. The orbiting motion, coupled with advancement of the drill bit 40 into the borehole 24, results in a combined milling and drilling action of the drill bit 40. This combination of dual motions allows the drill bit 40 to cut a hole larger than the outer diameter of the drill bit 40.

In certain embodiments, the inner string 28 and the intermediate string 30 are configured to prevent the inner string 28 from dropping through the intermediate string 30. For example, the inner string 28 may include a wide portion, the intermediate string 30 may include a narrow portion, and the wide portion may have an outer diameter that is greater than an inner diameter of the narrow portion. When handling the drill strings, the wide portion and the narrow portion act as a stop to prevent the inner string 28 from falling through intermediate string 30. The wide portion and the narrow portion may reduce the number of clamps needed for rod handling.

Figure 9:
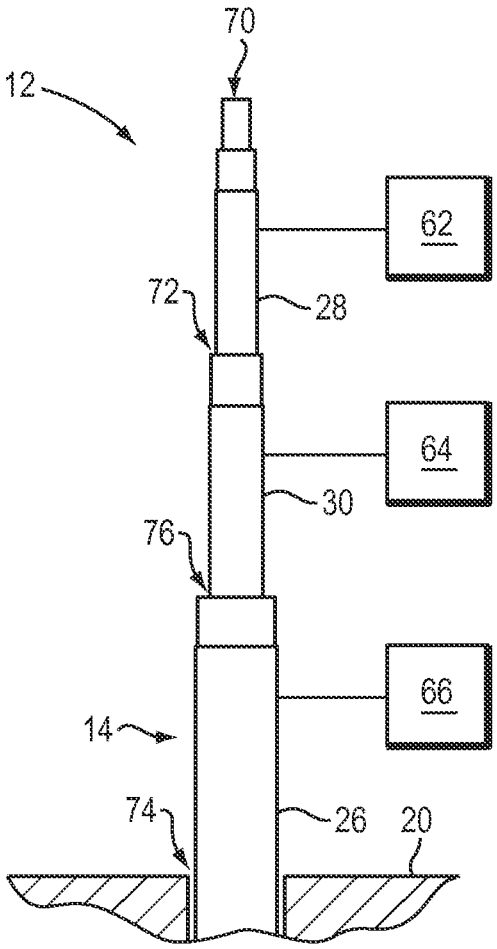
FIG. 9 is a schematic, side view of a drive assembly, in accordance with one embodiment of the invention.

FIG. 9 is a schematic diagram of the drive assembly 12 coupled to the drill string assembly 14, above the surface 20 of the ground, in accordance with certain embodiments of the invention. The drive assembly 12 includes an inner drive unit 62 coupled to the inner string 28, an intermediate drive unit 64 (e.g., a cross-arm assembly) coupled to the intermediate string 30, and an outer drive unit 66 coupled to the outer string 26. Each drive unit is configured to provide rotational motion (i.e., torque) and/or translational motion to its associated drive string. Positioning mechanisms may be included to adjust distances between the drive units, for example, for drill string handling and down-the-hole operations. As depicted, the arrangement of the drive units 62, 64, 66 generally includes the inner drive unit 62 (i.e., the high-speed drive head) on top, the intermediate drive unit 64 (i.e., the conduit drive head) in the middle, and the outer drive unit 66 (i.e., the outer string head) on the bottom.

The drive assembly 12 also includes fluid inputs and a fluid return. For example, an inner fluid (also referred to as a bit flushing fluid) is input to a hollow end 70 of the inner string 28. An intermediate fluid is input to an annulus 72 between the inner string 28 and the intermediate string 30. Finally, an outer fluid is input to an annulus 74 between the borehole 24 and the outer string 26. Upon introduction to the drill string assembly 14 and the borehole 24, each of the fluids travels along or through the drill string assembly 14 to the bottom hole assembly 16 where the fluids lubricate and cool the bottom hole assembly 16 (e.g., the drill bit 40), and collect or fluidize the cuttings. The fluids then return to the surface, with the cuttings, via an annular space 76 between the intermediate string 30 and the outer string 26. In one embodiment, use of a gas in one or more of the fluids (e.g., the intermediate fluid) provides extra lift to carry the cuttings to the surface 20. At the drive assembly 12, the return fluid may enter a collection unit (e.g., a tank) where the fluids may be separated from the cuttings and recycled or discharged. The drive assembly 12 includes fluid swivels (e.g., rotatory unions), as needed, to facilitate plumbing connections between supply and return line(s) and the rotating strings 26, 28, 30. The drive assembly 12 also includes floating subs, as needed, to facilitate making and breaking joints, for example, between the string sections. A floating sub is generally a component between a drive unit and the first section of drill pipe that transmits torque, but allows for axial movement within a short range. Use of a floating sub allows a top section of drill string to freely move in the axial direction, while being screwed together or apart from an adjacent section of drill string, so that the threads do not bind. Exemplary flowrate values for the various fluids are provided in Table 1.

In certain embodiments, the inner fluid, the intermediate fluid, and the outer fluid may be any type of fluid. For example, any or all of these fluids may include or consist essentially of water, brine, lubricating drilling mud, viscous drilling mud, weighted drilling mud, air (or other gas), saltwater, water-based fluid, drill-in fluid, oil-based fluid, synthetic-based fluid, and/or pneumatic drilling fluid. The characteristics of various drilling fluids, including preferred uses for the fluids, are summarized in Table 2.

TABLE 2

Exemplary Fluids and Fluid Characteristics.

| Fluid | Characteristics |
|---|---|
| Water | Minimum Viscosity, minimum density |
| Brine | Low Viscosity, higher density, completion fluid for maximizing oil & gas flow from target formation |
| Lubricant Drilling Mud | High Lubricity drilling mud for minimizing viscosity & minimizing wear drill rod wear |
| Viscous Drilling Mud | Used for bit cleaning, sealing the formation against fluid losses |
| Weighted Drilling Mud | A mud weighted with barite or other high density, finely ground material. Used for well control. |
| Air (e.g., as an additive to any other fluid) | Provides air lift to reduce the pressure drop across the fluid return path |

In various embodiments, particular fluid combinations may be utilized to satisfy a wide variety of drilling objectives, including well control, optimum rate of penetration (ROP) with minimal lost fluid, and completion while drilling. For example, well control typically refers to an ability to maintain control of the fluids in a well while drilling, especially when a high pressure formation or pocket is penetrated. Introducing weighted drilling mud (e.g., a mud weighted with barite or other high density, finely ground material) is a simple way to provide sufficient pressure (via the hydrostatic pressure) to keep formation gases and fluids from flowing into the wellbore in an uncontrolled manner. Active methods of increasing pressure on the formation, such as increasing pumping pressure and providing a choke on the return, are also possible. From a safety perspective, however, the passive nature of using weighted mud is preferred over active methods of well control.

If well control is lost due to the influx of fluids or gasses, a blowout preventer (BOP) may need to be activated, which may result in a total loss of the well and/or the drill string. In extreme cases, or in the case of a BOP failure, a drilling rig may be destroyed and crew members may be injured or killed. When well control is an issue due to the potential of high pressures within the formation, it is preferable to use weighted drilling fluids wherever possible. In such cases, weighted drilling mud may be used as the inner fluid, the intermediate fluid, and/or the outer fluid.

In many circumstances, well control is not an issue (e.g., when drilling shale or other formations that are resistant to fluid flow), so other drilling goals may dictate the particular fluid combination to be used. Drilling mud is typically viscous and increases the bottom hole pressure. Both of these characteristics increase the amount of energy required to destroy a unit of rock, and thus decrease overall ROP. Using water (which is less dense and less viscous than drilling mud) or water with air injection (which further reduces the bottom hole pressure) reduces the amount of energy required to destroy a unit of rock and allows for higher rates of penetration. With the triple string system described herein, water may be used as the inner fluid while mud is used as the outer fluid. This fluid combination may maximize ROP and may also build a filter cake that seals the borehole. In general, building the filter cake helps to keep all drilling fluids in the borehole, thereby minimizing damage to the formation and reducing the amount of drilling fluid lost to the formation, which can be expensive.

While drilling muds may seal off the target formation and minimize drilling fluid intrusion into the formation, a different option is to run a completion fluid as the outer fluid. Use of the completion fluid may maximize the ability of fluids to flow out of the reservoir once drilling is completed. The completion fluid may also reduce the amount of time the rig is on site. For example, by drilling with the completion fluid, tasks that are ordinarily done in serial (i.e., drilling first and pumping completion fluid later) may be done in parallel. When a completion fluid is used as the outer fluid, the other two fluids (i.e., the inner and intermediate fluids) may be chosen to achieve other objectives for the drilling program.

Table 3 lists fluid combinations that may be used to achieve different drilling objectives, in accordance with certain embodiments of the invention. In general, the drilling systems described herein are flexible and may accommodate a wide variety of fluids and fluid combinations to meet a wide variety of drilling objectives. During testing of the drilling systems, no problems with separation in the inner string 28 were encountered when using drilling muds as the inner fluid. Also, some drilling muds (e.g., polymer water based muds) make excellent lubricants.

TABLE 3

Exemplary Fluid Combinations.

| Objective | Inner Fluid | Intermediate Fluid | Outer Fluid |
|---|---|---|---|
| Well Control | Weighted Drilling Mud | Weighted and Lubricant Drilling Mud | Weighted Drilling Mud |
| High ROP with Minimal Fluid Loss | Water | Lubricant Drilling Mud | Viscous Drilling Mud |
| Oil and Gas Completion While Drilling | Brine w/Air Injection | Lubricant Drilling Mud | Brine |

In normal operation, the inner string 28 spins at high speed (e.g., 2000-30,000 rpm) while the outer string 26 spins at low speed (e.g., 10-300 rpm). The intermediate string 30 may be rotated with the outer string 26, or it may be rotated at a rate independent of the outer string 26. All three strings 26, 28, 30 are preferably advanced into the borehole 24 together when drilling.

Depending on the direction and/or rate of rotation of the bearing housing 36, the drill bit 40 can perform "climb milling" and/or "conventional milling," similar to the cutting actions available on millings machines found in a machine shop. For example, rotating the intermediate string 30 with the outer string 26 may produce a conventional milling action where cutters on an outer radius of the bit 40 progressively become more and more engaged with the borehole material until they exit into free space in the center of the borehole 24. Alternatively, rotating the intermediate string 30 independently of the outer string 26 may produce a climb milling action where the cutters of the drill bit 40 move through the free space near the center of the borehole, and then enter the working material at nearly right angles. As the cutter moves through the cut, the cutter engagement becomes progressively more shallow until it exits the cut. Use of climb milling may have several advantages, including longer bit life, ease of fixturing, improved borehole surface finish, lower power requirements, and better chip evacuation.

During bit changes or during down the hole operations, the intermediate string 30 and the inner string 28 (including the bearing housing 36, the driveshaft 34, and the drill bit 40) are pulled out of the hole. The outer string 26 and casing shoe 32, however, will typically be left in place and continuously rotated, while drilling fluid is pumped down between the borehole wall and the outer string 26. The drive assembly 12 may include a second outer drive unit to perform the rotation. Examples of down the hole operations include short run coring, drill stem testing (e.g., to measure fluids in the formation), hole surveying and logging (e.g., done through casing), and cementing (e.g., to cement a casing string into the borehole).

The drilling systems and devices described herein offer several advantages over previous systems. For example, the drilling systems provide increased rates of penetration during borehole creation. Very hard rocks are generally difficult to cut and penetrate with rotary drills. Previous drilling systems generally have a rate of penetration that is inversely related to the yield strength of the material being drilled, such that rocks with very high yield strengths are drilled much more slowly than rocks with low yield strengths. Compared to these previous systems, however, the drilling systems described herein apply about five to 20 times more energy to the rock being drilled. Accordingly, the drilled material is ground to very fine dust (i.e., few "chips" are produced), and the drilling system is less sensitive to the material being drilled.

The systems described herein also enable economical drilling of small diameter holes (e.g., less than about 5 inches in diameter). Previous drilling technologies experience significant drops in the rate of penetration once the hole diameter decreases below five inches. In some cases, the rate of penetration drops to zero or near zero, such that drilling costs may become prohibitive or non-economical. The new systems, however, maintain a high enough rate of penetration to remain economically advantageous when the bore diameter is at or below five inches. The higher rate of penetration associated with the new systems can dramatically reduce drilling times and operating costs. For example, the new systems may be used in construction to drill through formations or objects that include steel. Although the rate of penetration may be low due to the presence of the steel, there is an extremely high premium attached to the ability to have those holes completed.

The new drilling systems may further reduce costs by decreasing the number of casing strings and making casing placement easier and faster. For example, when the outer string is used as casing, it may be cemented in place once the target depth is reached and the intermediate and inner strings are pulled. This approach is easier than with previous open hole situations where installing casing can be difficult, particularly when caving and/or other borehole stability issues occur. In certain embodiments, the new systems allow the number of casing strings to be reduced because the systems are less likely to suffer from "lost return," which forces other systems to stop and case the hole. In a typical lost return situation, all or most of the drilling fluid is lost to the formation and does not return to the surface. A sufficient source of fluid (e.g., a lake, river, and/or tanker trucks) is generally required to continue drilling, which may be prohibitively expensive. In some circumstances, cuttings from lost return may re-enter the borehole and trap or pack the drill string assembly into place.

Another advantage of the new drilling systems described herein is that they reduce costs by using smaller amounts of drilling fluid additives. For example, with the new systems, drilling fluid (i.e. mud) is preferably used only in the fluid flow zone between the outer string 26 and the borehole 24. Clear drilling fluid (e.g., water) flows down the center of the inner string 28. The mud is preferably used only to stabilize the formation, while the clear drilling fluid provides most of the volume for removing cuttings. Further, since the cuttings are smaller than with previous systems, minimal additives are needed for suspending the cuttings in the return fluid.

The drilling systems described herein also reduce costs by requiring less manpower. For example, by using physically smaller drill strings, rigs, etc., fewer truckloads of equipment are needed, which require fewer people to physically manage, deploy, and operate. Further, the systems simplify the job of the drillers by avoiding or addressing many problems automatically, which allows fewer and/or less skilled workers to accomplish the same tasks. One problem avoided automatically is the chipping of drill bits on hard rock "stringers" when drilling a soft formation. The drilling systems described herein will simply drill more slowly in the harder formation, and then speed back up once the harder material has been penetrated. The systems also avoid disturbing the borehole wall during bit trips, which can cause the borehole to partially cave in. The 'cave' must then be drilled through to get back to bottom. "Spearing" into soft formations (e.g., clay) and burning up a bit is another problem that the systems automatically avoid. Since the outer string is generally in tension rather than compression, when the drill bit passes from a hard formation (which may require more weight or axial load on the drill bit) into a soft formation like clay, the bit will not jump ahead. With previous systems, the bit jumps into the soft clay, which chokes off the fluid flow to the bit. The bit then quickly heats up and is damaged or destroyed. Other issues that are avoided automatically include bit balling and keyholing.

Another advantage of the new drilling systems is that they provide additional degrees of freedom (i.e., parameters) that may be used for better control over borehole creation. For example, by utilizing three independent drill strings, each string may be translated (i.e., moved axially) relative to the other two strings, each string may be rotated relative to the other two strings, and each string may be held in a fixed relationship (axially and/or rotationally) relative to one or both of the other two strings. As described above, the drive units in the drive head assembly are configured to provide independent control over rotation and advancement of each string. The additional degrees of freedom are important for latching and unlatching the bottom hole assembly, directional drilling, achieving different milling actions (e.g., conventional milling or climb milling), controlling the thrust loading on the drill bit, and putting the intermediate string 30 in compression. For example, by putting the intermediate string 30 in compression, the intermediate string 30 is locked into place, so that it can control any vibrations from the inner string 28. Also, when the outer string 26 is in tension, it will tend to resist deflection, resulting a straighter borehole 24. The operator can adjust the compression or tension in the drill strings, for example, to create a bend in the borehole 24.

An additional advantage is that the systems produce very fine cuttings and include the annular space between the outer string 26 and the intermediate string 30 for easy removal of the cuttings from the borehole 24, which is often a significant problem with previous systems. With the new systems, as cuttings are produced they are directly transported into the annular space between the outer string 26 and the intermediate string 30, thereby preventing cuttings from collecting in the annulus between the borehole and the outer string. The outer string 26 is rotating, which continuously changes the orientation of gravity (e.g., with respect to a point on the wall of the outer string 26) and prevents any chips from settling on the "down" side of the outer string 26 when drilling a horizontal or inclined borehole. When coupled with the very fine chip size, which minimizes the settling velocity of the cuttings, the systems provide very robust cuttings removal from the borehole (a potentially significant issue when drilling inclined and horizontal wells).

Advantageously, the drilling systems described herein may be used to perform directional drilling to produce curved or deflected boreholes. For example, referring again to FIG. 6, directional drilling may be achieved by holding the casing shoe 32 fixed with a narrowest part 55 of the casing shoe 32, due to the eccentric bore 52, oriented in the direction of the desired borehole deflection. The intermediate string 30 is then rotated (to orbit the drill bit 40) while the inner string 28 is turning at high speed to perform the cutting. This technique will cut a hole that is slightly offset from the previous cut or borehole direction. By repeating the process many times, the borehole can be steered in the direction desired.

In another example, referring to FIGS. 7 and 8, the driveshaft 34 may be "plunged ahead" to advance the drill bit 40 ahead of the casing shoe 32, thereby forming a pilot hole. Because the driveshaft 34 is oriented at a slight angle (about two degrees) with respect to the centerline of the borehole 24, the pilot hole is deflected slightly from the centerline of the borehole 24. When the bottom hole assembly 16 is further advanced into the borehole 24, and tension in the outer string 26 is optionally relieved (e.g., to make the outer string 26 more flexible), the bottom hole assembly 16 will tend to follow the pilot hole. Repeating this plunging process in the same direction will build the deflection. Due to the additional degrees of freedom provided by the drilling system 10, other ways of directionally drilling may be performed and are contemplated.

The new systems also improve the ability of the drilling fluids to return to the surface 20. For example, injecting air into the intermediate fluid decreases the density of the return fluid, which reduces the pressure that must be exerted to cause the return fluid to flow from the drill bit 40 to the surface 20. In cases of fractured formations where the fluid normally wants to flow out into the formation, air lift can help reduce the fluid lost to the formation. Some systems, including high-speed dual string systems, are unable to provide air lift.

An additional advantage of the new systems is that they require less torque and therefore less capital intensive equipment. Previous rotary systems require massive, high-torque towers to lift and apply the necessary torques (e.g., thousands of ft-lbs) to rotate the heavy drill strings. By comparison, the systems and devices described herein transfer power down the hole via high speed (i.e., high RPM), not high torque. The new systems may therefore use thinner walled tubing, which is lighter and less expensive. In turn, the lifting and torque requirements for the tower or mast are reduced, which allows a smaller, more mobile rig to be used. Torque values for the drilling systems described herein are provided in Table 1.

Further, compared to previous dual string systems, the triple string systems described herein provide an additional flow zone for the drilling fluids. The additional flow zone advantageously allows for greater control over the flowrates and types of fluids introduced to the system, including gas. The additional flow zone also isolates the high-speed inner string 28 from the return fluid, which is abrasive and could otherwise damage the inner string 28. Further, inclusion of the third string (i.e., the intermediate string) traps and stabilizes the inner string 28, thereby reducing wear and tear on the inner string 28.

Each numerical value presented herein, for example, in a table, a chart, or a graph, is contemplated to represent a minimum value or a maximum value in a range for a corresponding parameter. Accordingly, when added to the claims, the numerical value provides express support for claiming the range, which may lie above or below the numerical value, in accordance with the teachings herein. Absent inclusion in the claims, each numerical value presented herein is not to be considered limiting in any regard.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. The features and functions of the various embodiments may be arranged in various combinations and permutations, and all are considered to be within the scope of the disclosed invention. Accordingly, the described embodiments are to be considered in all respects as only illustrative and not restrictive. Furthermore, the configurations, materials, and dimensions described herein are intended as illustrative and in no way limiting. Similarly, although physical explanations have been provided for explanatory purposes, there is no intent to be bound by any particular theory or mechanism, or to limit the claims in accordance therewith.

What is claimed is:

1. A drilling system for boring into ground, the drilling system comprising a bottom hole assembly comprising:
- a rotatable casing shoe comprising a distal end;
- an independently rotatable driveshaft disposed within the casing shoe, the driveshaft comprising a bit disposed at a distal end thereof extending beyond the casing shoe distal end;
- a bearing housing interdisposed between the driveshaft and the casing shoe to control a distance between a centerline of the driveshaft and a centerline of the casing shoe, wherein the driveshaft centerline and the casing shoe centerline are substantially parallel and radially offset; and
- a drill string assembly coupled to the bottom hole assembly, the drill string assembly comprising:
  - an outer drill string coupled to the casing shoe;
  - an inner drill string disposed within the outer drill string and coupled to the driveshaft, the inner drill string forming an interior passage; and
  - an intermediate drill string interdisposed between the outer drill string and the inner drill string, the intermediate drill string coupled to the bearing housing.

2. The drilling system of claim 1, wherein the casing shoe comprises a cutter at a distal end thereof.

3. The drilling system of claim 1, wherein at least one of the casing shoe and the bearing housing define an internal passage to permit drilling fluid and any cuttings to be conveyed away from a cutting zone toward a proximal end of the casing shoe.

4. The drilling system of claim 1, wherein the driveshaft comprises tubing forming an internal passage adapted to direct drilling fluid to the bit.

5. The drilling system of claim 1, wherein the bearing housing is adapted to be rotationally locked with the casing shoe.

6. The drilling system of claim 5, wherein the bearing housing is axially translatable relative to the casing shoe between a retracted disengaged position to an extended engaged position.

7. The drilling system of claim 6, wherein the bearing housing comprises a projection adapted to mate with an aperture formed in the casing shoe.

8. The drilling system of claim 7, wherein the projection comprises a pair of wings and the aperture comprises a corresponding pair of longitudinally disposed slots.

9. The drilling system of claim 8, wherein the slots are canted circumferentially.

10. The drilling system of claim 1, wherein the bearing housing is adapted to rotate with respect to the casing shoe.

11. The drilling system of claim 10, wherein the bearing housing forms an offset bore to support the driveshaft and comprises a radial support adapted to mate positively with an internal surface of the casing shoe.

12. The drilling system of claim 11, wherein the casing shoe comprises an axial stop adapted to limit axial advancement of the bearing housing with respect to the casing shoe.

13. The drilling system of claim 1, wherein at least one of the casing shoe, the driveshaft, and the bearing housing are adapted to be translated longitudinally relative to at least one other.

14. The drilling system of claim 1, wherein each of the casing shoe, the driveshaft, and the bearing housing are adapted to be translated longitudinally relative to each other.

15. The drilling system of claim 1, further comprising a surface assembly, the surface assembly comprising:

a drive assembly comprising:

an outer drive unit coupled to the outer drill string;

an inner drive unit coupled to the inner drill string; and an intermediate drive unit coupled to the intermediate drill string; and a pump assembly comprising:

an outer pump adapted to pump an outer fluid between ground and the outer drill string;

an inner pump adapted to pump an inner fluid through the interior passage of the inner drill string; and an intermediate pump adapted to pump an intermediate fluid through an annular space formed between the intermediate drill string and the inner drill string.

16. The drilling system of claim 15, wherein the outer drive unit is adapted to rotate the casing shoe relative to ground.

17. The drilling system of claim 15, wherein the outer drive unit is adapted to longitudinally translate the casing shoe relative to ground.

18. The drilling system of claim 15, wherein the inner drive unit is adapted to rotate the driveshaft relative to ground.

19. The drilling system of claim 15, wherein the inner drive unit is adapted to longitudinally translate the driveshaft relative to ground.

20. The drilling system of claim 15, wherein the intermediate drive unit is adapted to rotate the bearing housing relative to ground.

21. The drilling system of claim 15, wherein the intermediate drive unit is adapted to longitudinally translate the bearing housing relative to ground.

22. The drilling system of claim 15, wherein each of the outer drive unit, the inner drive unit, and the intermediate drive unit is adapted to be locked to at least one of ground and another drive unit.

23. The drilling system of claim 15, wherein the drive assembly further comprises a second outer drive unit coupled to the outer drill string.

24. The drilling system of claim 15, wherein the outer fluid, the inner fluid, and the intermediate fluid each comprise at least one member selected from the group consisting of water, brine, lubricant drilling mud, viscous drilling mud, and weighted drilling mud.

25. The drilling system of claim 24, wherein at least one of the outer fluid, the inner fluid, and the intermediate fluid comprises a gaseous component.

26. The drilling system of claim 1, wherein the inner drill string comprises a wide portion and the intermediate drill string comprises a narrow portion to prevent the inner drill string from dropping through the intermediate drill string.

27. A method for boring into ground, the method comprising the steps of:

orbiting and advancing into the ground a high speed rotating bit mounted to a driveshaft to form a bore having a nominal diameter;

following the bit with a casing shoe independently rotating at lower speed and having a diameter substantially equivalent to the nominal diameter; and controlling a distance between a centerline of the driveshaft and a centerline of the casing shoe with a bearing housing interdisposed between the driveshaft and the casing shoe, such that the driveshaft centerline and the casing shoe centerline are substantially parallel and radially offset, wherein (i) an outer drill string is coupled to the casing shoe;

(ii) an inner drill string is disposed within the outer drill string and coupled to the driveshaft, the inner drill string forming an interior passage; and (iii) an intermediate drill string is interdisposed between the outer drill string and the inner drill string, the intermediate drill string is coupled to the bearing housing.

28. The method of claim 27, wherein the controlling step comprises adjusting the distance between the centerline of the driveshaft and the centerline of the casing shoe by longitudinally translating the bearing housing.

29. The method of claim 27, wherein the controlling step comprises adjusting the distance between the centerline of the driveshaft and the centerline of the casing shoe by rotating the bearing housing.

30. The method of claim 27, further comprising:

pumping an inner fluid through the interior passage of the inner drill string;

pumping an intermediate fluid through a first annulus between the inner drill string and the intermediate drill string; and pumping an outer fluid through a second annulus between the bore and the outer drill string.

* * * * *